US006454348B1

(12) United States Patent
Wu

(10) Patent No.: US 6,454,348 B1
(45) Date of Patent: Sep. 24, 2002

(54) FOLDABLE CHAIR ASSEMBLY

(76) Inventor: Chung-Sen Wu, 3F, No. 8, Lane 295, Sec. 1, Fu-Hsing S. Rd., Taipei City (TW)

( * ) Notice: Subject to any disclaimer, the term of this patent is extended or adjusted under 35 U.S.C. 154(b) by 0 days.

(21) Appl. No.: 09/853,238

(22) Filed: May 11, 2001

(51) Int. Cl.[7] ..... A47C 4/30

(52) U.S. Cl. ..... 297/16.2; 297/35; 297/46; 297/45; 297/47

(58) Field of Search ..... 297/16.2, 35, 45, 297/46, 47

(56) References Cited

U.S. PATENT DOCUMENTS 5,893,605 A * 4/1999 Chang ..... 297/16.2 X
6,082,813 A * 7/2000 Chen ..... 297/16.2
6,149,238 A * 11/2000 Tsai ..... 297/45 X
6,231,119 B1 * 5/2001 Zheng ..... 297/16.2
6,247,748 B1 * 6/2001 Zheng ..... 297/16.2
6,247,749 B1 * 6/2001 Yu ..... 297/16.2
6,247,750 B1 * 6/2001 Tsai ..... 297/16.2
6,322,138 B1 * 11/2001 Tang ..... 297/16.2 X
6,382,715 B1 * 5/2002 Tang ..... 297/16.2
6,382,729 B1 * 5/2002 Wu ..... 297/16.2 X

* cited by examiner

*Primary Examiner*—Rodney B. White
(74) *Attorney, Agent, or Firm*—Timothy J. Keefer; Wildman, Harrold, Allen & Dixon

(57) ABSTRACT

A foldable chair assembly includes front and rear leg rods, sleeve members sleeved slidably and respectively on the leg rods, a fabric seat connected to the sleeve members, a fabric backrest connected to the rear leg rods, and four foldable cross-frames connected pivotally to the leg rods and the sleeve members. Each of a pair of armrest rods is connected pivotally to one of the front leg rods at one end, and is connected movably to one of the rear leg rods at the other end.

14 Claims, 4 Drawing Sheets

FOLDABLE CHAIR ASSEMBLY

BACKGROUND OF THE INVENTION

1. Field of the Invention

The invention relates to a foldable chair assembly, more particularly to a foldable chair assembly that is comfortable to use and that saves a lot of space when folded.

2. Description of the Related Art

FIG. 1 illustrates a conventional foldable chair assembly 100 having a pair of opposing rectangular side frames 11, a pair of inverted U-bars 13, a fabric seat 15, and a fabric backrest 16. Each of the side frames 11 has a lower end portion formed with a pair of downwardly extending legs 111, and an upper end portion provided with an armrest 113. The inverted U-bars 13 have intersecting intermediate portions that are pivoted to each other, lower end portions that are connected pivotally and respectively to the lower end portions of the side frames 11, and upper end portions that are connected pivotally and respectively to the upper end portions of the side frames 11 via link bars 17. The seat 15 has opposite lateral sides secured to the upper end portions of the inverted U-bars 13, respectively. The backrest 16 is disposed on one end of the side frames 11. The link bars 17 are designed to reinforce the structure of the foldable chair 100 and to facilitate folding of the latter. However, as shown in FIG. 2, the chair assembly 100 still occupies a lot of space after folding because the depth of the chair 100 cannot be reduced.

Another conventional foldable chair assembly 200 is illustrated in FIG. 3. The chair assembly 200 includes: a pair of upright rear leg rods 23; foldable front, rear, left and right cross-frames 22; a fabric seat 24; and a fabric backrest 26. Each of the rear leg rods 23 has a lower end portion provided with a foot pad 21. A sleeve member 25 is sleeved slidably and respectively between the upper and lower end portions of each of the rear leg rods 23. Each of the cross-frames 22 is formed from a pair of cross-bars having intermediate portions that are pivoted to each other, lower end portions that are connected pivotally and respectively to the foot pads 21, and upper end portions. Two connectors 27 are disposed opposite to the sleeve members 25. One of the connectors 27 is connected pivotally to the front and left cross-frames 22. The other one of the connectors 27 is connected pivotally to the front and right cross-frames 22. The upper end portions of the rear, left and right cross-frames 22 are further connected pivotally and respectively to the sleeve members 25. The seat 24 has four corners connected respectively to the sleeve members 25 and the connectors 27. The backrest 26 has opposite lateral sides secured to the upper end portions of the rear leg rods 23. Although the foldable chair assembly 200 can save a lot of space when folded, as shown in FIG. 4, the chair assembly 200 is uncomfortable to use because it has no armrests.

SUMMARY OF THE INVENTION

Therefore, the main object of the present invention is to provide a foldable chair assembly that is comfortable to use and that saves a lot of space when folded.

Accordingly, a foldable chair assembly of this invention comprises a pair of upright front leg rods, a pair of upright rear leg rods, a pair of front sleeve members, a pair of rear sleeve members, a fabric seat, a fabric backrest, a foldable front cross-frame, a foldable rear cross-frame, a foldable left cross-frame, a foldable right cross-frame, and a pair of armrest rods. Each of the front leg rods has an upper end portion and a lower end portion. Each of the rear leg rods has an upper end portion and a lower end portion. Each of the front sleeve members is sleeved slidably and respectively on the front leg rods between the upper and lower end portions of the front leg rods. Each of the rear sleeve members is sleeved slidably and respectively on the rear leg rods between the upper and lower end portions of the rear leg rods. The fabric seat has four corner portions connected respectively to the front and rear sleeve members. The fabric backrest has opposite lateral sides connected respectively to the upper end portions of the rear leg rods. The foldable front cross-frame has a lower end section connected pivotally to the lower end portions of the front leg rods, and an upper end section connected pivotally to the front sleeve members. The foldable rear cross-frame has a lower end section connected pivotally to the lower end portions of the rear leg rods, and an upper end section connected pivotally to the rear sleeve members. The foldable left cross-frame has a lower end section connected pivotally to the lower end portions of a first adjacent pair of the front and rear leg rods, and an upper end section connected pivotally to a first adjacent pair of the front and rear sleeve members. The foldable right cross-frame has a lower end section connected pivotally to the lower end portions of a second adjacent pair of the front and rear leg rods, and an upper end section connected pivotally to a second adjacent pair of the front and rear sleeve members. Each of the armrest rods has a front end portion connected pivotally to the upper end portion of a respective one of the front leg rods, and a rear end portion connected movably to a respective one of the rear leg rods.

BRIEF DESCRIPTION OF THE DRAWINGS

Other features and advantages of the present invention will become apparent in the following detailed description of the preferred embodiments with reference to the accompanying drawings, of which:

Referring to FIG. 5, the first preferred embodiment of a foldable chair assembly 300 according to the present invention is shown to include a pair of upright front leg rods 33, a pair of upright rear leg rods 34, a pair of front sleeve members 321, a pair of rear sleeve members 322, a fabric seat 37, a fabric backrest 38, a foldable front cross-frame 361, a foldable rear cross-frame 362, a foldable left cross-frame 363, a foldable right cross-frame 364, and a pair of armrest rods 35. Each of the front leg rods 33 has an upper end portion 332 and a lower end portion 333. Each of the rear leg rods 34 has an upper end portion 343 and a lower end portion 344. The rear leg rods 34 are longer than the front leg rods 33. The lower end portion 333, 344 of each of the front and rear leg rods 33, 34 is provided with a foot pad 31. Each of the front sleeve members 321 is sleeved slidably and respectively on the front leg rods 33 between the upper and lower end portions 332, 333 of the front leg rods 33. Each of the rear sleeve members 322 is sleeved slidably and respectively on the rear leg rods 34 between the upper and lower end portions 343, 344 of the rear leg rods 34. The fabric seat 37 has four corner portions 373 connected respectively to the front and rear sleeve members 321, 322. Each of the front and rear leg rods 33, 34 extends through the four corner portions 373 of the fabric seat 37. The fabric backrest 38 has opposite lateral sides 383 connected respectively to the upper end portions 343 of the rear leg rods 34. The fabric seat 37 has a rear end 372, and the fabric backrest 38 has a lower end 382 connected to the rear end 372 of the fabric seat 37. The foldable front cross-frame 361 has a lower end section 3612 connected pivotally to the lower end portions 333 of the front leg rods 33, and an upper end section 3611 connected pivotally to the front sleeve members 321. The foldable rear cross-frame 362 has a lower end section 3622 connected pivotally to the lower end portions 344 of the rear leg rods 34, and an upper end section 3621 connected pivotally to the rear sleeve members 322. The foldable left cross-frame 363 has a lower end section 3632 connected pivotally to the lower end portions 333, 344 of a first adjacent pair of the front and rear leg rods 33, 34, and an upper end section 3631 connected pivotally to a first adjacent pair of the front and rear sleeve members 321, 322. The foldable right cross-frame 364 has a lower end section 3642 connected pivotally to the lower end portions 333, 344 of a second adjacent pair of the front and rear leg rods 33, 34, and an upper end section 3641 connected pivotally to a second adjacent pair of the front and rear sleeve members 321, 322. Each of the front, rear, left and right cross-frames 361, 362, 363, 364 includes first and second cross-bars 365, 366 having intermediate portions 367 that are pivoted to each other. The lower end sections 3612, 3622, 3632, 3642 of the front, rear, left and right cross-frames 361, 362, 363, 364 are connected pivotally to foot pads 31 on the front and rear leg rods 33, 34. Each of the armrest rods 35 has a front end portion 352 connected pivotally to the upper end portion 332 of a respective one of the front leg rods 33, and a rear end portion 353 connected movably to the upper end portion 343 of a respective one of the rear leg rods 34. The upper end portion 332 of each of the front leg rods 33 is provided with a pivot connector 331 for connecting pivotally with the front end portion 352 of the respective one of the armrest rods 35. In this embodiment, the upper end portion 343 of each of the rear leg rods 34 is provided with a rod fastener 341 for engaging removably the rear end portion 353 of the respective one of the armrest rods 35. The rod fastener 341 has a generally U-shaped cross-section to define a clamping groove 3412 for receiving removably the rear end portion 353 of the respective one of the armrest rods 35 therein. The rod fastener 341 has a fastener wall formed with a limiting notch 342. The rear end portion 353 of each of the armrest rods 35 is formed with a radial limiting projection 351 that engages removably the limiting notch 342 in the rod fastener 341 on the respective one of the rear leg rods 34.

Figure 1:
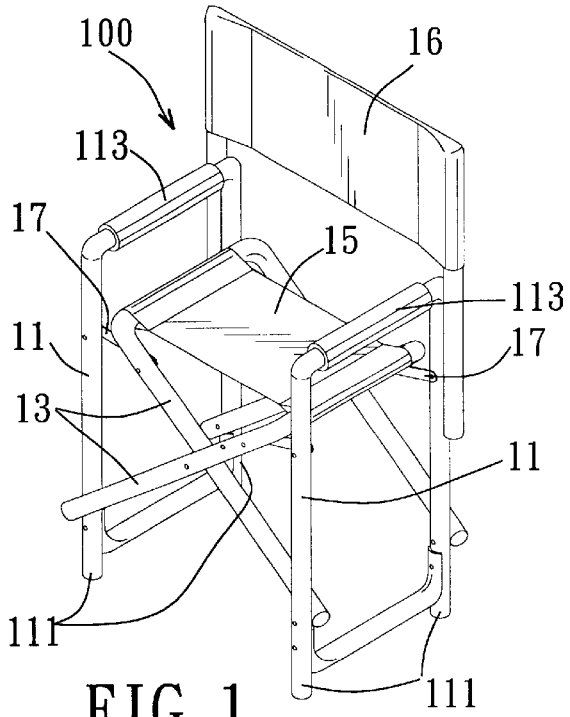
FIG. 1 PRIOR ART
FIG. 1 is a perspective view of a conventional foldable chair assembly.
Figure 2:
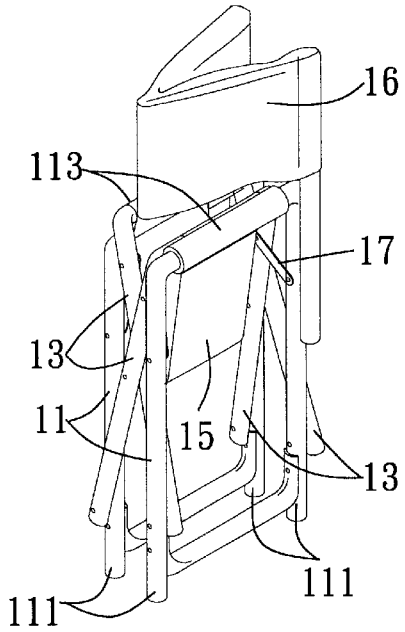
FIG. 2 PRIOR ART
FIG. 2 is a perspective view illustrating the chair assembly of FIG. 1 in a folded state.
Figure 3:
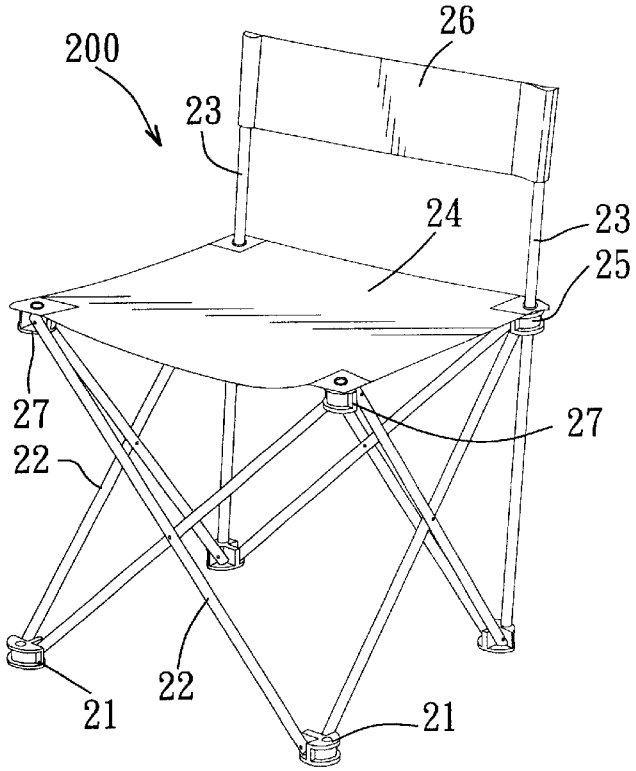
FIG. 3 PRIOR ART
FIG. 3 is a perspective view of another conventional foldable chair assembly.
Figure 4:
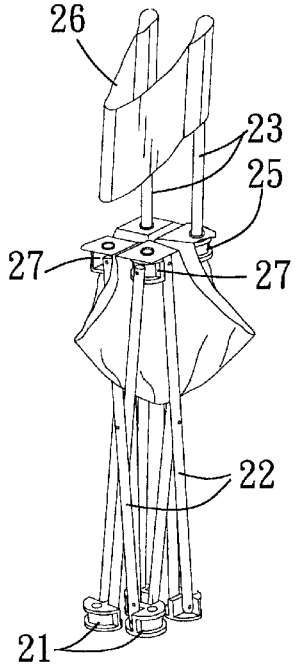
FIG. 4 PRIOR ART
FIG. 4 is a perspective view of FIG. 3 in a folded state.
Figure 5:
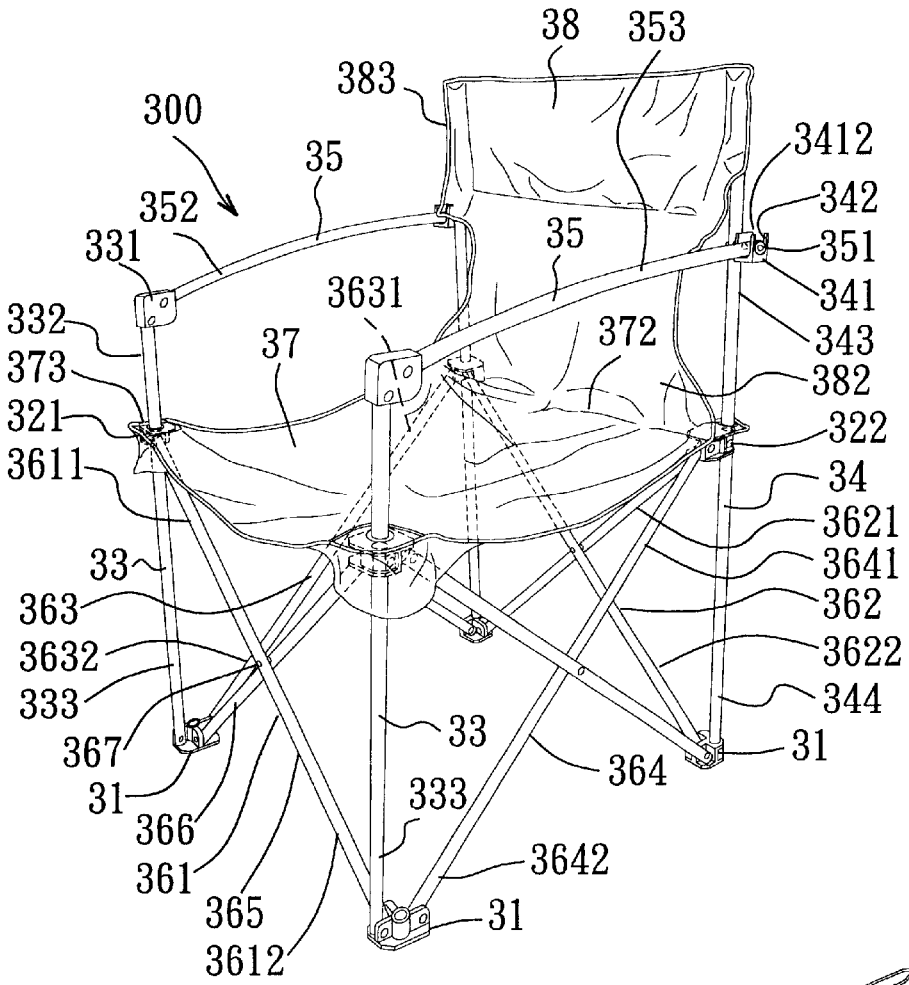
FIG. 5 is a perspective view of the first preferred embodiment of a foldable chair assembly according to the present invention.
Figure 6:
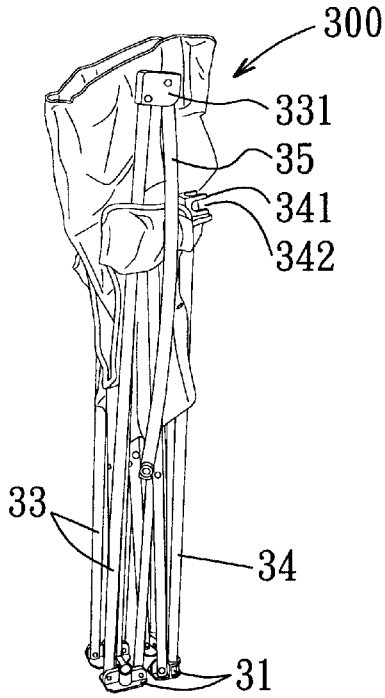
FIG. 6 is a perspective view illustrating the first preferred embodiment in a folded state.

In use, the four cross-frames 361, 362, 363, 364 are opened fully to form a rectangular baase. The extent of the opening of the cross-frames 361, 362, 363, 364 is controlled by the four corner portions 373 of the fabric seat 37 which are connected to the front and rear sleeve members 321,322, respectively. Then, the radial limiting projection 351 of each of the armrest rods 35 is engaged in the limiting notch 342 of the rod fastener 341 on the respective rear leg rod 34, thereby fastening the armrest rods 35 to the rod fasteners 341 of the rear leg rods 34. The chair assembly 300 is now ready for use. To fold the chair assembly 300, the radial limiting projection 351 of each of the armrest rods 35 is disengaged from the limiting notch 342 of the rod fastener 341 on the respective rear leg rod 34, thereby causing the armrest rods 35 to move pivotally to a position in parallel with the front leg rods 33, and thereby permitting folding of the cross-frames 361, 362, 363, 364. When the cross-frames 361, 362, 363, 364 are fully folded, the front and rear leg rods 33, 34 are disposed close to each other. As such, the chair assembly 300 does not occupy a lot of space when folded, as shown in FIG. 6.

Figure 7:
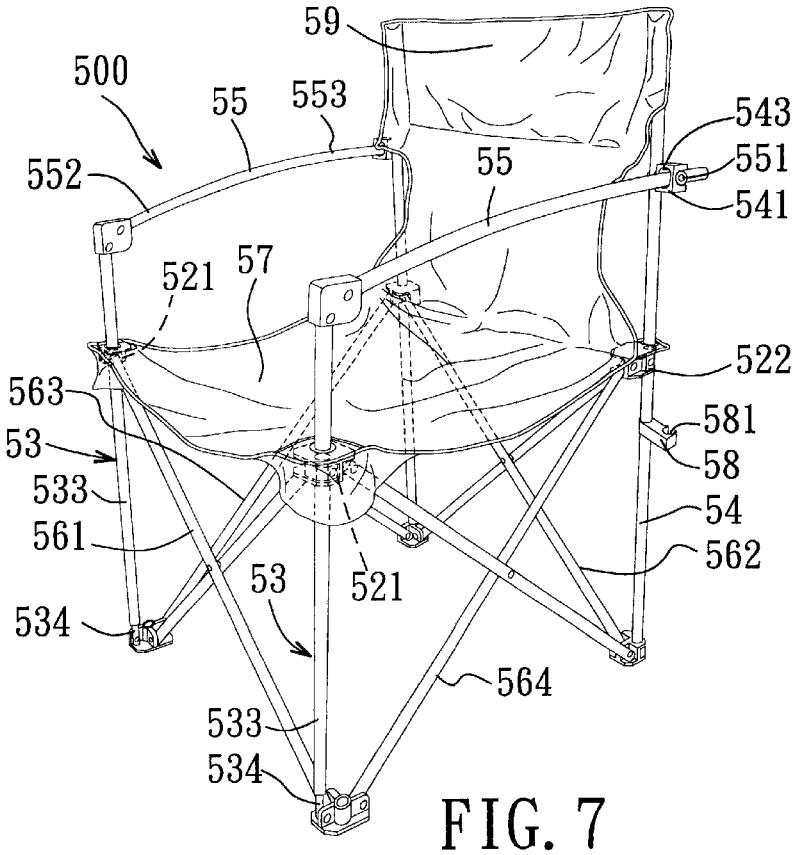
FIG. 7 is a perspective view of the second preferred embodiment of a foldable chair assembly according to the present invention.
Figure 10:
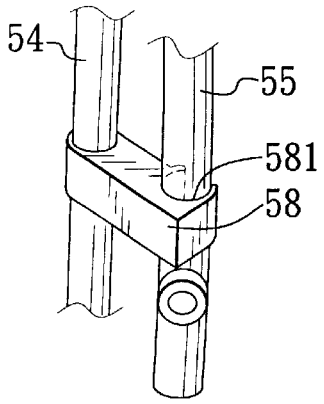
FIG. 10 is a fragmentary perspective view of the second preferred embodiment.

FIG. 7 illustrates the second preferred embodiment of a foldable chair assembly 500 of the present invention. Like the previous embodiment, the foldable chair assembly 500 comprises: a pair of upright front and rear leg rods 53, 54; a pair of front and rear sleeve members 521, 522; a fabric seat 57; a fabric backrest 59; foldable front, rear, left and right cross-frames 561, 562, 563, 564; and a pair of armrest rods 55. The main difference between the present and previous embodiments resides in the construction of the rod fastener 541. The rod fastener 541 is formed with a through-hole 543 that permits the rear end portion 553 of the respective one of the armrest rods 55 to extend slidably therethrough, and has a fastener wall formed with a limiting notch 542. The rod fastener 541 is pivotally retained at the respective rear leg rod 54. The rear end portion 553 of each of the armrest rods 55 is formed with a radial limiting projection 551 that engages removably the limiting notch 542 in the rod fastener 541 on the respective one of the rear leg rods 54. A screw member (not shown) can be used in place of the radial limiting projection 551. Moreover, in the present embodiment, each of the front leg rods 53 includes an inner tube portion 534 that is connected pivotally to the front cross-frame 561 and a corresponding one of the left and right cross-frames 563, 564, and an outer tube portion 533 that is connected slidably and telescopically to the inner tube portion 534, that has a respective one of the front sleeve members 521 and one corner of the fabric seats 57 sleeved slidably thereon, and that is connected pivotally to the front end portion 552 of the respective one of the armrest rods 55. Furthermore, a rod retainer 58 is mounted on at least one of the rear leg rods 54 and is formed with a retaining groove 581 for engaging removably a corresponding one of the armrest rods 55, as shown in FIG. 10. The rod retainer 58 is disposed below the rear sleeve member 522 on the respective rear leg rod 54.

Figure 8:
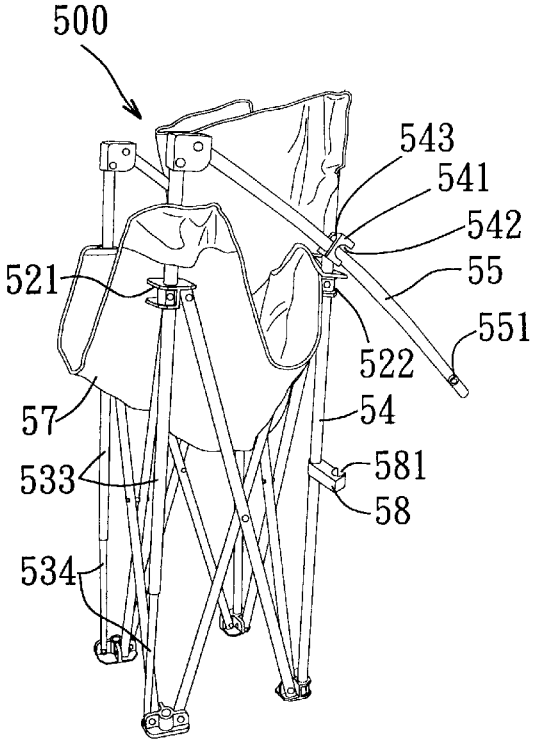
FIG. 8 is a perspective view illustrating how an armrest rod moves relative to a rod fastener during folding of the chair assembly of the second preferred embodiment.

Use of the second preferred embodiment is conducted in a manner substantially similar to that of the previous preferred embodiment. One of the armrest rods 55 that is engaged in the retaining groove 581 of the rod retainer 58 is removed first. Then, the cross-frames 561,562, 563, 564 are spread open. At the same time, each of the armrest rods 55 moves pivotally upward, as shown in FIG. 8, until the radial limiting projection 551 of each of the armrest rods 55 extends into the limiting notch 542 of the respective rod fastener 541. The armrest rods 55 are now fastened on the rear leg rods 54, as shown in FIG. 7, and the chair assembly

500 is now ready for use. When folding the chair assembly 500, the cross-frames 561, 562, 563, 564 are folded first so as to cause each of the armrest rods 55 to slide through the rod fasteners 541 and to move pivotally downward, as shown in FIG. 8. The front and rear leg rods 53,54 are brought close to each other at this time. Then, one of the armrest rods 55 is fastened in the retaining groove 581 of the rod retainer 58, thereby preventing undesired unfolding movement of the foldable chair assembly 500.

Figure 9:
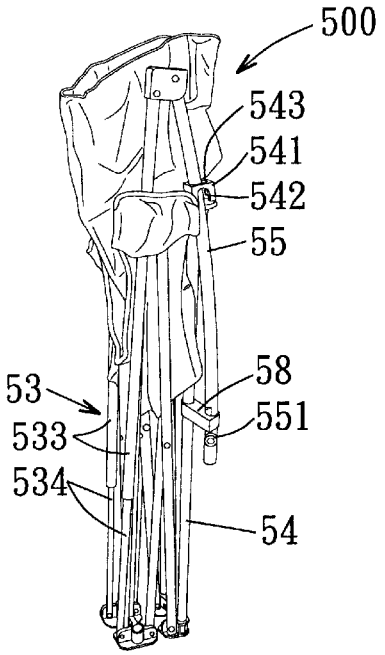
FIG. 9 is a perspective view illustrating the second preferred embodiment in a folded state.

As shown in FIG. 9, the chair assembly 500 does not occupy a lot of space when folded.

Figure 11:
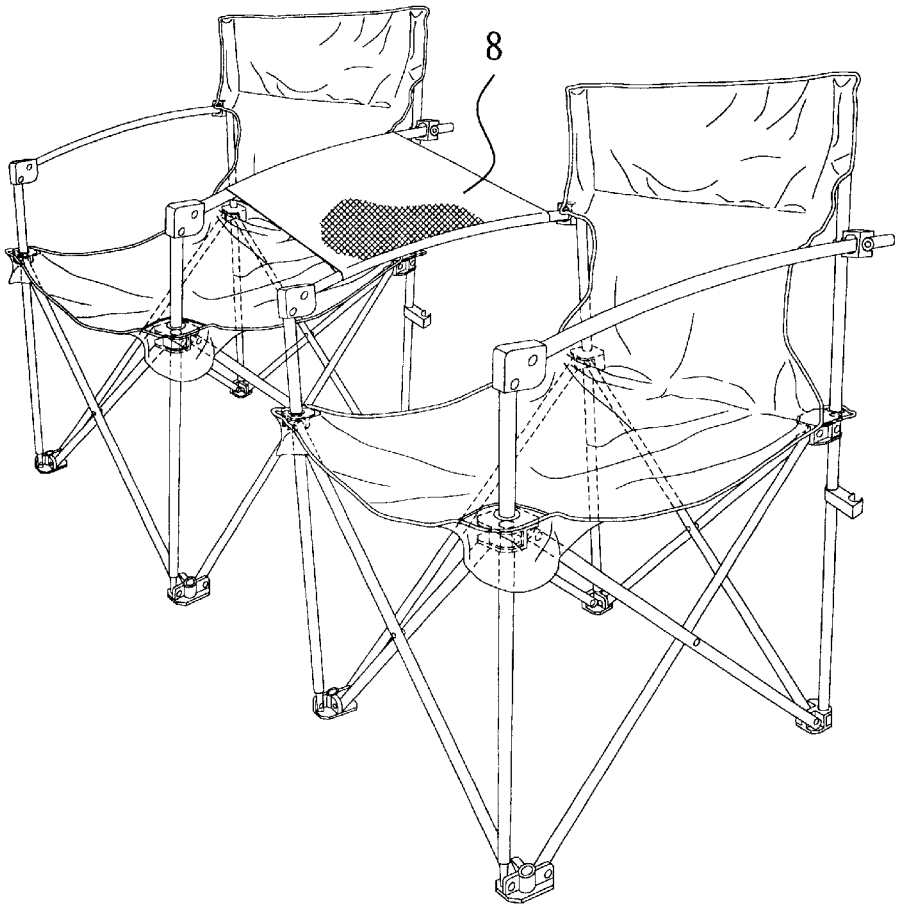
FIG. 11 is a perspective view illustrating two foldable chair assemblies according to the second preferred embodiment when placed side-by-side.

Referring to FIG. 11, the foldable chair assembly of the present invention can be placed side-by-side, and a fabric support 8 can be attached to adjacent armrest rods of the chair assemblies to form a table.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A foldable chair assembly comprising:

a pair of upright front leg rods, each of which has an upper end portion and a lower end portion;

a pair of upright rear leg rods, each of which has an upper end portion and a lower end portion;

a pair of front sleeve members sleeved slidably and respectively on said front leg rods between said upper and lower end portions of said front leg rods;

a pair of rear sleeve members sleeved slidably and respectively on said rear leg rods between said upper and lower end portions of said rear leg rods;

a fabric seat having four corner portions connected respectively to said front and rear sleeve members;

a fabric backrest having opposite lateral sides connected respectively to said upper end portions of said rear leg rods;

a foldable front cross-frame having a lower end section connected pivotally to said lower end portions of said front leg rods, and an upper end section connected pivotally to said front sleeve members;

a foldable rear cross-frame having a lower end section connected pivotally to said lower end portions of said rear leg rods, and an upper end section connected pivotally to said rear sleeve members;

a foldable left cross-frame having a lower end section connected pivotally to said lower end portions of a first adjacent pair of said front and rear leg rods, and an upper end section connected pivotally to a first adjacent pair of said front and rear sleeve members;

a foldable right cross-frame having a lower end section connected pivotally to said lower end portions of a second adjacent pair of said front and rear leg rods, and an upper end section connected pivotally to a second adjacent pair of said front and rear sleeve members; and a pair of armrest rods, each of which has a front end portion connected pivotally to said upper end portion of a respective one of said front leg rods, and a rear end portion connected movably to said upper end portion of a respective one of said rear leg rods.

2. The foldable chair assembly of claim 1, wherein each of said front, rear, left and right cross-frames includes first and second cross-bars having intermediate portions that are pivoted to each other.

3. The foldable chair assembly of claim 1, wherein said fabric seat has a rear end, and said fabric backrest has a lower end connected to said rear end of said fabric seat.

4. The foldable chair assembly of claim 1, wherein said upper end portion of each of said front leg rods is provided with a pivot connector for connecting pivotally with said front end portion of the respective one of said armrest rods.

5. The foldable chair assembly of claim 1, wherein said lower end portion of each of said front and rear leg rods is provided with a foot pad, said lower end sections of said front, rear, left and right cross-frames being connected pivotally to said foot pads on said front and rear leg rods.

6. The foldable chair assembly of claim 1, wherein said upper end portion of each of said rear leg rods is provided with a rod fastener for engaging removably said rear end portion of the respective one of said armrest rods.

7. The foldable chair assembly of claim 6, wherein said rod fastener has a generally U-shaped cross-section to define a clamping groove for receiving removably said rear end portion of the respective one of said armrest rods therein.

8. The foldable chair assembly of claim 7, wherein said rod fastener has a fastener wall formed with a limiting notch, said rear end portion of each of said armrest rods being formed with a radial limiting projection that engages removably said limiting notch in said rod fastener on the respective one of said rear leg rods.

9. The foldable chair assembly of claim 1, wherein each of said rear leg rods is provided with a rod fastener formed with a through-hole that permits said rear end portion of the respective one of said armrest rods to extend slidably therethrough.

10. The foldable chair assembly of claim 9, wherein said rod fastener has a fastener wall formed with a limiting notch, said rear end portion of each of said armrest rods being formed with a radial limiting projection that engages removably said limiting notch in said rod fastener on the respective one of said rear leg rods.

11. The foldable chair assembly of claim 9, wherein each of said front leg rods includes an inner tube portion that is connected pivotally to said front cross-frame and a corresponding one of said left and right cross-frames, and an outer tube portion that is connected slidably and telescopically to said inner tube portion, that has a respective one of said front sleeve members sleeved slidably thereon, and that is connected pivotally to said front end portion of the respective one of said armrest rods.

12. The foldable chair assembly of claim 1, further comprising a rod retainer mounted on one of said rear leg rods and formed with a retaining groove for engaging removably one of said armrest rods.

13. The foldable chair assembly of claim 12, wherein said rod retainer is disposed below said rear sleeve member on said one of said rear leg rods.

14. The foldable chair assembly of claim 1, wherein said rear leg rods are longer than said front leg rods.

* * * * *